US006036527A

United States Patent [19]

White et al.

[11] Patent Number: 6,036,527

[45] Date of Patent: *Mar. 14, 2000

[54] CONTACTS FOR INSULATION DISPLACEMENT CONNECTORS

[75] Inventors: Rowland Spencer White, Lunenburg, Mass.; David Ernest Ivey, Whitchurch, United Kingdom

[73] Assignee: Molex Incorporated, Lisle, Ill.

[ * ] Notice: This patent issued on a continued prosecution application filed under 37 CFR 1.53(d), and is subject to the twenty year patent term provisions of 35 U.S.C. 154(a)(2).

[21] Appl. No.: 08/737,227

[22] PCT Filed: May 30, 1995

[86] PCT No.: PCT/GB95/01246

§ 371 Date: Nov. 19, 1996

§ 102(e) Date: Nov. 19, 1996

[87] PCT Pub. No.: WO95/34105

PCT Pub. Date: Dec. 14, 1995

[30] Foreign Application Priority Data

Jun. 2, 1994 [GB] United Kingdom ..... 9411060

[51] Int. Cl.[7] ..... H01R 4/74

[52] U.S. Cl. ..... 439/395; 439/408

[58] Field of Search ..... 439/395, 404, 439/405, 408

[56] References Cited

U.S. PATENT DOCUMENTS

| | | | |
|---|---|---|---|
| 3,950,062 | 4/1976 | Reavis, Jr. | 439/97 |
| 4,296,988 | 10/1981 | Warner | 439/398 |
| 4,436,360 | 3/1984 | Knickerbocker | 439/404 |
| 4,553,808 | 11/1985 | Weidler et al. | 439/395 |
| 4,913,659 | 4/1990 | Doyle | 439/395 |
| 5,482,467 | 1/1996 | Nolf et al. | 439/395 |
| 5,554,048 | 9/1996 | Martins | 439/395 |

FOREIGN PATENT DOCUMENTS

| | | | |
|---|---|---|---|
| 0000624A1 | 6/1978 | European Pat. Off. | H01R 9/08 |
| 0000624 | 2/1979 | European Pat. Off. . | |
| 0 271 413 | 6/1988 | European Pat. Off. | H01R 4/24 |
| 0 274 948 | 7/1988 | European Pat. Off. | H01R 4/24 |
| 3526707A1 | 1/1987 | Germany | H01R 4/24 |
| 906665 | 9/1962 | United Kingdom . | |
| 1 362 416 | 8/1974 | United Kingdom | H01R 9/08 |

*Primary Examiner*—Neil Abrams
*Assistant Examiner*—Katrina Davis
*Attorney, Agent, or Firm*—A. A. Tirva

[57] ABSTRACT

An insulation displacement contact (1) has a generally semi-circular configuration. A longitudinal slot (2) and a lateral slot (22) extending from the base of the longitudinal slot define a pair of tines (24). The free ends of the tines (AA,BB) are parallel to one another to assist location in an insulation displacement connector housing (12).

6 Claims, 2 Drawing Sheets

CONTACTS FOR INSULATION DISPLACEMENT CONNECTORS

FIELD OF THE INVENTION

This invention relates to insulation displacement connectors (IDCs) for use, e.g. in the communications industry. It is particularly concerned with the design of contacts used in IDCs and their fixing in IDC housings.

BACKGROUND TO THE INVENTION

In the application of insulation displacement connectors (IDC's) in the communications industry, it is often desirable to be able to connect two wires into a single contact. Many methods of achieving this have been devised. Some consist of a single planar metal contact with two slots, each to accommodate one wire, but more sophisticated designs which can connect two wires in a single insulation displacement slot have generally proved more simple in use, and generally therefore more commercially acceptable.

One of the most used connectors is made by Krone GmbH of Berlin, Germany, and sold as the LSA PLUS connector. The construction is described in DE 2,725,551 and uses a planar metallic contact constrained within a plastic connector body to remain at 45° to the wire to be terminated. In use, when two wires are inserted, the contact, which is constrained both at the top and the bottom of the slot, will flex and deform symmetrically around two wires of the same size. Because of the symmetrical nature of the contact's mechanics, this system has the disadvantage that it will only work satisfactorily with two wires of the same conductor size. It has the further disadvantage that it requires the wire to be securely gripped within the connector body to overcome the mechanical forces tending to rotate the conductor into mechanical equilibrium at 90° to the IDC contact.

Another form of IDC capable of terminating two wires is described in U.S. Pat. No. 4,141,618. This contact is cylindrical and has an axial slot in which wires may be inserted. It is mechanically superior to the design disclosed in DE 2,725,551, because it is capable of functioning without either the wire or the contact having to be constrained in any state of tension or torsion. However, it has the disadvantages that it requires a relatively large amount of material to manufacture the contact, and it is not possible to make connection to a wire without cutting the wire; thus, it is not possible to have a pass-through connection, which is often desirable in communications wiring. For these reasons, despite its excellent connection characteristics, it has been a relatively unsuccessful contact in the industry.

Another form of contact can be made, by the use of two IDC blades each at 45° to the wire. This is described first in GB 1,361,127 with most recent techniques being disclosed in U.S. Pat. No. 5,044,979, and WO 91/22941. This contact has the advantage of incorporating the mechanical equilibrium of the slotted cylinder arrangement, with the feed-through wiring capability of the 45° contact of DE 2,725,551. It has been commercially manufactured by the present applicant for several years, and has proved functionally reliable in the termination of two wires of the same conductor size. The design attempts to replicate the function of the slotted cylinder contact, but uses flat blades, and hence a simplified manufacturing process. It has the disadvantages of requiring a very precise mechanical restraint system in the plastic body of the connector to restrain the contact blades from rotation, and like the 45° planar contact, can only work with two wires of the same conductor size because it is constrained to deform symmetrically around the conductors by its mechanical arrangement.

It is desirable to increase the functionality of IDC's in the telecommunications industry. It would be particularly desirable to produce a contact which can either terminate more than two wires of the same size, or two wires of slightly different conductor size, such as is possible with the contacts disclosed in U.S. Pat. No. 4,141,618, but which does not suffer from the disadvantages associated with split cylinder type contacts discussed previously.

The invention resides generally in the provision of a contact which is generally arcuate. More specifically there is provided a contact for an insulation displacement connector comprising a first contact portion for receiving one or more wires and a second contact portion, the first contact portion having a central longitudinal slot defining a pair of contact tines, and being of generally arcuate shape.

The invention also resides in an insulation displacement connector housing a plurality of insulation displacement contacts as defined.

Preferably the first contact portion is semi-elliptical and symmetrical about the longitudinal slot. One preferred construction is semi-circular. The arcuate construction may have parallel end portions to assist retention in a housing.

The use of an arcuate contact portion overcomes the disadvantages of the split cylinder design in that it has a feed through capacity. However it retains the advantage that two wires of different thicknesses may be retained at the same time. Moreover it avoids the disadvantage of the V shaped contact as precise mechanical restraint in the plastic housing of the connector is not necessary.

BRIEF DESCRIPTION OF THE DRAWINGS

Embodiments of the invention will now be described, by way of example, and with reference to the accompanying drawings, in which.

DESCRIPTION OF BEST MODE

Figure 1:
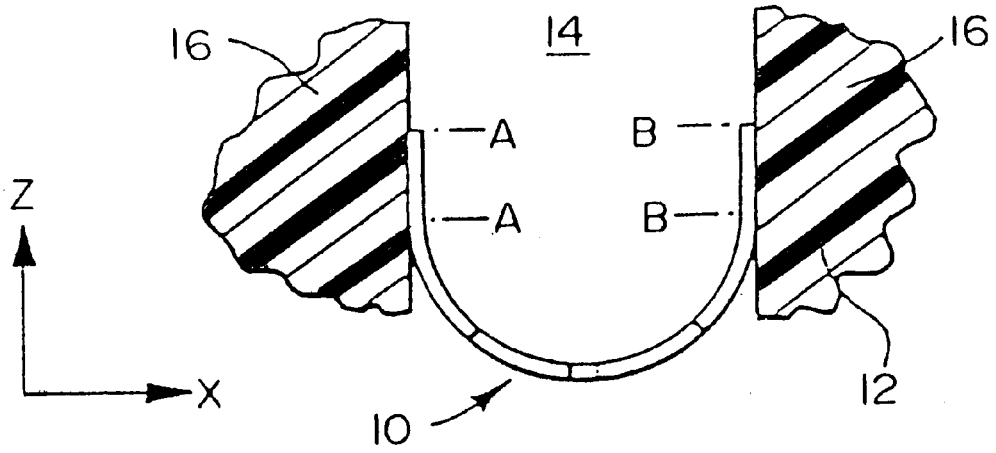
FIG. 1 is a top view of a part-cylindrical contact received in an IDC housing and embodying the invention.
Figure 2:
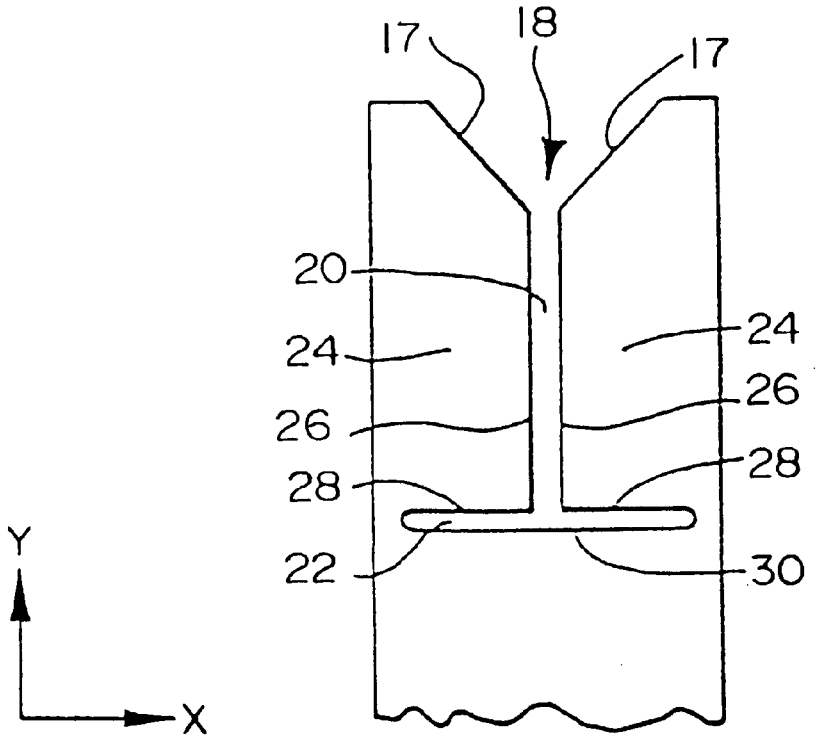
FIG. 2 is a front view of the contact of FIG. 1 housing the contact slot.

Referring to FIGS. 1 and 2, the contact 10 is shown received in a slot in a IDC housing 12. The IDC housing is only shown in part for ease of understanding and it is to be understood that any housing is suitable for receiving the contacts, for example, the housings disclosed in the aforementioned WO 92/22941. The contact is part-cylindrical and the functional part of the contact is semi-circular although other arcuate contact shapes could be used. Moreover, the free ends of the contact may be extended. In FIG. 1 the ends AA and BB are parallel and assist in seating the contact in the housing slot 14. Movement outwards of the sides of the contact is constrained by the plastic side walls 16 of the slot in the connector body. Thus, the side walls 16 act as a restraining means to prevent spreading of the contact outwards on insertion of a wire.

Referring to FIG. 2, the contact has a pair of sloping walls 17 defining a tapered wire entry portion 18 which, on insertion of a wire, slices the wire insulation. The entry portion 18 tapers to a longitudinal slot 20 at the base which extends, on either side of the slot, a lateral slot 22. The lateral slot defines a pair of tines 24 on either side of the longitudinal slot 20 and allows the side walls 26 of the tines, which define the longitudinal slot, to open parallel to one another when wires are inserted. It will be appreciated that when wires are inserted, the tines will move in both the X and Z axes as defined in FIG. 1.

The base of the contact is not illustrated in the figures as it is not germane to the invention. Any suitable base construction may be chosen depending on the nature of the contact to be made. For example, a post type tail may be used for connection to a printed circuit board. Another type of connector base is shown in WO 92/22941. The appropriate base is a simple matter of design choice and is known to those skilled in the art.

The slot in the housing may be a simple rectangular cavity which is very easy to manufacture and much more simple than the constructions required to anchor the V type contacts of WO 92/22941.

Figure 3:
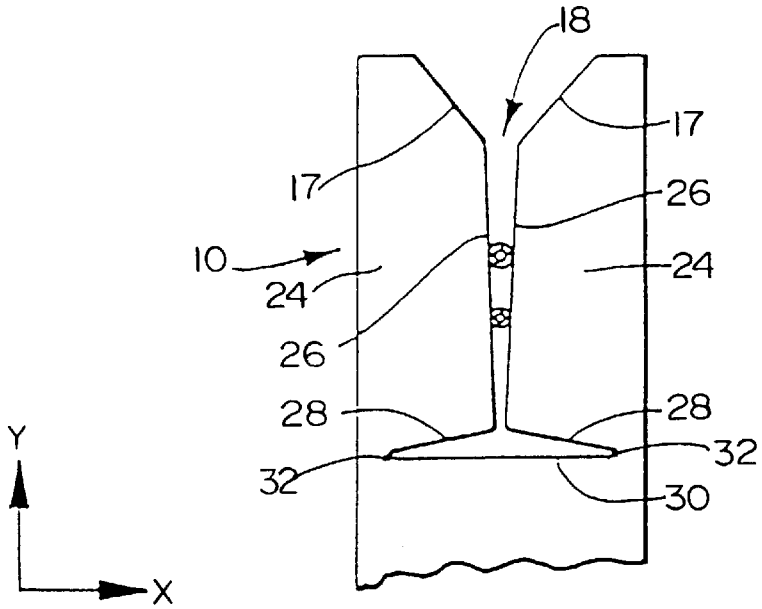
FIG. 3 is a similar view to the FIG. 2 showing how the contact behaves with two wires of differing diameter.

FIG. 3 shows how the contact behaves when two wires of different diameter are inserted into the slot. The movement of the tines is exaggerated for clarity and it can be seen how the tines will move additionally in the Y direction. Thus, the side walls 26 which define the longitudinal slot are no longer parallel and the bottom walls 28 are no longer parallel to the bottom wall 30 of the lateral slot. In effect, each tine is pivoting about a respective end 32 of the longitudinal slot.

It is preferable, as shown in FIG. 3, that the larger diameter wire is inserted last. However this is not essential. If the larger wire is inserted first, the direction of movement in the Y direction will be the opposition of that illustrated.

Figure 4:
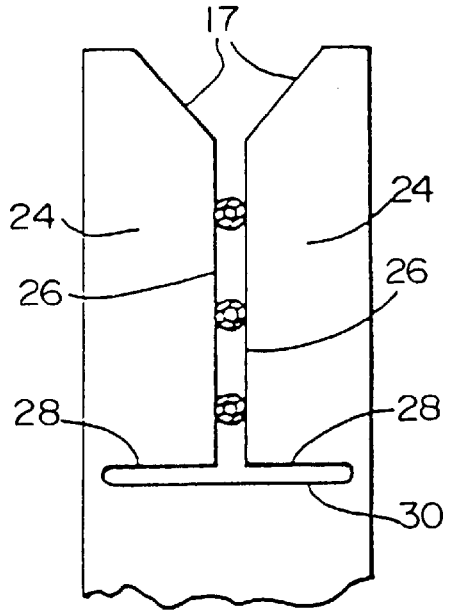
FIG. 4 is a similar view to FIGS. 2 and 3, showing how the contact behaves with more than two wires of similar diameter.

In FIG. 4, three wires of equal diameter are shown inserted in the longitudinal slot 20. As the half-cylinder will deform symmetrically due to the symmetrical nature of the displacement forces caused by the wires, the side walls 26 of the tines will remain parallel. The contact will work just as well with only two wires and, depending on the length of the slot, can work with more than three wires.

Figure 5:
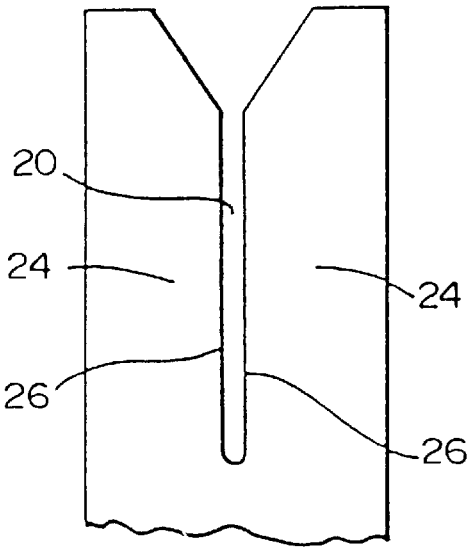
FIG. 5 is a similar view to FIG. 2 of an alternative embodiment of the invention.

In an alternative embodiment illustrated in FIG. 5, the longitudinal slot is relatively long with respect to the wire conductor diameter enabling the lateral slot to be omitted.

Other possible embodiments will be apparent to those skilled in the art. For example the contact form can be semi-elliptical instead of semi-circular, or it can be a greater or lesser segment of a circle or ellipse, provided that this segment is great enough to allow the contact to function mechanically. Alternatively the shape could be formed of successive shorter planar portions, instead of being a continuous curve. All these contacts are generally arcuate in shape.

The tines have been described as symmetrical about the longitudinal slot 20. While this is desirable it is not essential. An asymmetric arrangement could be used whereby one tine is fixed allowing only the other blade to move. When mounted in a plastic connector body, the contacts may either be disposed on one side of the center line of the connector, or alternatively inverted to reduce the overall length of the connector for a given number of contacts, as disclosed in WO 92/22941.

We claim:

1. An insulation displacement connector comprising a contact having a first contact portion for receiving one or more wires and a second contact portion, the first contact portion having a longitudinal axis and being of generally uniform arcuate shape in a direction generally parallel to the longitudinal axis and having a central longitudinal slot extending substantially parallel to the longitudinal axis, said longitudinal slot defining a pair of tines extending in a direction generally transverse to the longitudinal axis and a housing having an aperture for receiving the contact wherein the aperture has side walls which act to restrain said tines to prevent spreading of the tines on insertion of a wire into the longitudinal slot.

2. An insulation displacement connector according to claim 1, wherein the first contact portion includes a lateral slot extending from the base of the central longitudinal slot on both sides of the central longitudinal slot.

3. An insulation displacement connector according to claim 1, wherein the first portion is semicircular.

4. An insulation displacement connector according to claim 1, wherein the free ends of the first contact portion have substantially parallel portions in continuous contact with the housing along their entire length.

5. An insulation displacement connector according to claim 1, wherein the first contact portion is symmetrical about the central longitudinal slot.

6. An insulation displacement connector comprising a contact having a first contact portion for receiving at least one wire, said first contact portion having a longitudinal axis and having a generally uniform U-shaped portion in a direction generally parallel to the longitudinal axis, the legs of the U-shaped portion extending in a direction generally transverse to the longitudinal axis, said-U-shaped portion of said first contact portion having a central longitudinal slot extending substantially parallel to the longitudinal axis for receiving said one wire, and a housing having an aperture for receiving the contact wherein the aperture has side walls which act to restrain said legs to prevent spreading of the legs on insertion of a wire into the longitudinal slot.

* * * * *